United States Patent [19]

Kikuchi et al.

[11] 4,367,124

[45] Jan. 4, 1983

[54] PROCESS FOR PREPARING LITHOGRAPHIC PRINTING PLATE BASES

[75] Inventors: Nobuji Kikuchi, Hazaki; Yoshiyuki Kisaka; Kazuo Torige, both of Tokyo; Masayuki Onose, Yokohama, all of Japan

[73] Assignee: Mitsubishi Chemical Industries, Limited, Tokyo, Japan

[21] Appl. No.: 279,757

[22] Filed: Jul. 2, 1981

[30] Foreign Application Priority Data

Jul. 18, 1980 [JP] Japan ..... 55/98247

[51] Int. Cl.[3] ..... C25D 11/16; C25F 3/04

[52] U.S. Cl. ..... 204/17; 204/33; 204/129.85; 204/129.95

[58] Field of Search ..... 204/129.85, 129.95, 204/17, 33

[56] References Cited

U.S. PATENT DOCUMENTS 4,052,275 10/1977 Gumbinner ..... 204/129.95

4,172,772 10/1979 Ould ..... 204/129.95

*Primary Examiner*—T. Tufariello

*Attorney, Agent, or Firm*—Oblon, Fisher, Spivak, McClelland & Maier

[57] ABSTRACT

There is disclosed a process for preparing lithographic printing plate bases, which comprises electrolytically etching a sheet made of aluminum or an aluminum alloy in an electrolytic solution containing hydrochloric acid and a $\beta$-dicarbonyl compound.

10 Claims, No Drawings

PROCESS FOR PREPARING LITHOGRAPHIC PRINTING PLATE BASES

BACKGROUND OF THE INVENTION

1. Field of the Invention:

This invention relates to a process for preparing lithographic printing plate bases made of aluminum or an aluminum alloy. More specifically, it relates to a process for preparing lithographic printing plate bases which possess a surface superior in hydrophilicity and water retention properties and which has a good adhesion to a photosensitive coating layer provided on the aluminum or aluminum alloy sheet and an outstanding resistance to printing.

2. Description of the Prior Art

One of the base materials for lithographic printing plates which have heretofore been used is aluminum sheets which, in most cases, are grained or roughened prior to use by mechanical polishing, chemical etching, electrolytic etching or similar technique in order to improve their hydrophilicity for dampening water used in printing procedure, water retention properties and adhesion to a photosensitive coating layer provided thereon.

The surface topographies of the grained aluminum sheets greatly contribute to the plate making performance of the coated sheets and the printing performance as printing plates. Therefore it is highly important to control the surface topograhies of the grained aluminum sheets.

For instance, those grained surface in which relatively fine, shallow pits are present densely are suitable as printing plate bases for use on a proof press for which a good image reproducibility and a high resolving power are required. On the other hand, those grained surface in which the pits are deep and uniform in diameter (uniform microscopically) are suitable as printing plate bases for use on a regular press for which a marked water retention and a high resistance to printing are required.

Among various graining techniques, particularly electrolytic etching techniques have attracted attention in recent years because it makes possible the production of a wide variety of grained surface varying from a relatively fine, shallow grain to a deep and uniform one, as compared with mechanical polishing techniques including ball polishing and brush polishing and chemical etching techniques.

In the electrolytic etching process, an aluminum sheet is generally immersed in a suitable electrolyte solution and electrolyzed with direct or alternating current to grain the surface.

The most well-known electrolyte for this purpose is hydrochloric acid. However, when hydrochloric acid is used in electrolytic etching of an aluminum sheet, it is difficult to produce deep grains which are uniform in microscopic topography (e.g., topography observed under magnification to 100 to 1,200 diameter on a microscope or the like.) Therefore, particularly when used as printing plate bases for use on a regular press, these bases are not always satisfactory in adhesion properties of the coating layer in the image area and in resistance to printing, although they are superior in water retention properties and in removability of the coating layer in the non-image area during developing process.

Accordingly, there is a continuing need for a lithographic printing base which is superior in water retention and resistance to printing.

SUMMARY OF THE INVENTION

Thus, in brief, the present invention resides in a process for preparing lithographic printing plate bases, which comprises electrolytically etching a sheet made of aluminum or an aluminum alloy in an electrolytic solution containing hydrochloric acid and a $\beta$-dicarbonyl compound.

DETAILED DESCRIPTION OF THE PREFERRED EMBODIMENTS

The aluminum sheet to which the process of the present invention is applied may be a pure aluminum sheet or a sheet of an aluminum alloy which consists of a predominant amount of aluminum and a minor amount or amounts of one or more metals such as silicon, magnesium, iron, copper, zinc, manganese, chromium, etc.

Since the surface of the sheet of aluminum or aluminum alloy (hereinafter referred to as "aluminum sheet") is contaminated with grease, rust, dust and the like, the aluminum sheet is desirably degreased and cleansed in a conventional manner prior to electrolytic etching. For example, the aluminum sheet may be subjected to solvent degreasing with trichlene, thinner, etc. and/or emulsion degreasing with a combination of kerosine and triethanolamine, etc., then immersed in an aqueous sodium hydroxide solution of 1 to 10% concentration at 20° to 70° C. for 5 seconds to 10 minutes to remove such contaminants that cannot be removed by degreasing alone and natural oxide layer, and finally immersed in an aqueous nitric or sulfuric acid solution of 10 to 20% concentration at 10° to 50° C. for 5 seconds to 5 minutes for the purpose of neutralization after the alkali etching and removal of smuts.

In accordance with the invention, the aluminum sheet is electrolytically etched in a electrolytic solution containing hydrochloric acid and a $\beta$-dicarbonyl compound.

The $\beta$-dicarbonyl compound has the effect of controlling the production of the grains with small pit diameter and uniformly producing the grains with relatively large pit diameters. Such $\beta$-dicarbonyl compounds are represented by the following formula:

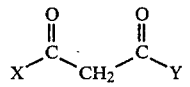

wherein X and Y independently are alkyl, phenyl or alkoxy. Exemplary of these compounds are acetylacetone, benzylacetone, methyl acetoacetate, ethyl acetoacetate, ethyl malonate and the like.

The above compounds may be used alone or in combination. Usually, the electrolytic solution of this invention contains 3.5 to 35 g/l, preferably 7 to 21 g/l of hydrochloric acid and 0.01 to 20 g/l, preferably 0.1 to 10 g/l of the $\beta$-dicarbonyl compound.

An excessively high concentration of hydrochloric acid tends to cause the formation of smuts as well as the formation of grains which is not uniform in macroscopic surface appearance. For this reason, it is preferred that the concentration of hydrochloric acid be not greater than 35 g/l.

On the other hand, if the concentration of hydrochloric acid is too low, the pits produced by electrolytic etching do not become microscopically uniform so that it is preferably not lower than 3.5 g/l.

The concentration of the β-dicarbonyl compound is preferably not greater than 20 g/l since excessively high concentration makes the surface topographies of the central and edge parts of the grained aluminum sheets uneven. On the other hand, if the concentration of the β-dicarbonyl compound is too low, the effect of adding this compound is not sufficient. Hence, the concentration of the β-dicarbonyl compound is preferably not lower than 0.01 g/l.

The temperature of the electrolyte is usually in the range of 10° to 40° C.

The current density varies with the desired depth of grains and is usually in the range of 20 to 200 A/dm$^2$, preferably in the range of 50 to 150 A/dm$^2$.

When an aluminum sheet is electrolytically etched under the above-mentioned conditions, the grains produced are suitable for use as printing plates in that the diameter (average diameter) of the pits is uniform and that the pits are present sufficiently close to each other to minimize the area of flat plateau-like surface.

The electrolytic etching according to the present invention can be conducted either batchwise or continuously. The continuous process can be performed, for example, by passing an aluminum web continuously through an electrolytic cell.

The electrolytically etched aluminum sheet may be desmutted, as required, by immersing in an aqueous solution of an alkali or acid at a temperature of from room temperature to 80° C. for 1 to 5 minutes and then neutralized in a conventional manner prior to use as a printing plate base. It is a matter of course that prior to use the aluminum sheet may be subjected to anodic oxidation in a conventional manner. This is conducted by electrolysis in an aqueous solution of sulfuric acid, phosphoric acid or the like of 10 to 50% concentration at a current density of 1 to 10 A/dm$^2$. After anodization, the aluminum sheet may be further subjected to sealing or made hydrophilic, as required, using hot water or a silicate, dichromate, acetate, hydrophilic polymeric compound or the like.

The type of photosensitive materials which can be applied to the aluminum sheet treated as above in accordance with the present invention is not critical, and any of various known materials may be used. Exemplary of these materials are compositions of a hydrophilic polymer and a diazonium salt, diazo compounds such as diazodiphenylamine, compositions of a quinonediazide compound and an alkali-soluble resin, a polymer of unsaturated carboxylic acids dimerizable by irradiation with active radiation (e.g., a polymer of cinnamic acid or phenylenediacrylic acid), compositions of a compound polymerizable by irradiation with active radiation and a polymeric binder, azide compounds and the like.

A photosensitive lithographic printing plate can be prepared by dissolving a photosensitive material as above in a suitable solvent together with one or more of various known additives, then applying the solution to an aluminum sheet prepared in accordance with the present invention, and drying the coated sheet. The photosensitive lithographic printing plate thus prepared can afford a printing plate which is excellent in hydrophilicity and water retention and which is also excellent in resistance to printing due to extremely strong adhesion between the photosensitive material in the image area and the aluminum sheet base, when an original is placed on the printing plate and the plate is exposed and developed in a conventional manner.

Having generally described the invention, a further understanding can be obtained by reference to certain specific examples which are provided herein for purpose of illustration only and are not intended to be limiting unless otherwise specified.

EXAMPLES 1-7 AND COMPARATIVE EXAMPLES 1 AND 2

A 0.3 mm-thick aluminum sheet (Alloy Designations 1050, Temper H16) was immersed in an aqueous 1% sodium hydroxide solution at 50° C. for a minute to effect alkali etching, and then washed water. Thereafter it was further immersed in 10% nitric acid at 25° C. for a minute for purpose of neutralization and desmutting, and then washed with water.

The aluminum sheet is then subjected to electrolytic etching under the conditions indicated in Table 1 below, thereby providing in each working example a grained sheet having a uniform pit diameter as compared with the comparative examples.

TABLE 1

| | Composition of electrolytic solution | | Conditions of electrolysis | | | | | |
|---|---|---|---|---|---|---|---|---|
| | HCl (Mole/l) | β-dicarbonyl compound (g/l) | Bath temp. (°C.) | Current density (A/dm$^2$) | Time (sec.) | Average roughness Ra (μ) | (a) Microscopic topography | (b) Macroscopic surface appearance |
| Comparative Example 1 | 0.5 (18 g/l) | — | 25 | 50 | 30 | 0.73 | X | O |
| Comparative Example 2 | 0.8 (29 g/l) | — | " | 100 | 20 | 0.82 | X | X |
| Example 1 | 0.3 (11 g/l) | acetyl acetone 3 | " | 60 | 20 | 0.73 | O | O |
| Example 2 | 0.5 (18 g/l) | acetyl acetone 3 | " | 80 | 20 | 0.79 | O | O |
| Example 3 | 0.8 (29 g/l) | acetyl acetone 1 | " | 60 | 30 | 0.84 | O | O |
| Example 4 | 0.5 (18 g/l) | ethyl aceto-acetate 1 | " | 90 | 20 | 0.70 | O | O |
| Example 5 | 0.5 (18 g/l) | ethyl aceto-acetate 5 | "90 | 20 | 0.77 | O | O | |
| Example 6 | 0.5 (18 g/l) | ethyl malonate 1 | " | 90 | 20 | 0.69 | O | O |
| Example 7 | 0.5 | ethyl malonate | " | 90 | 20 | 0.57 | O | O |

TABLE 1-continued

| Composition of electrolytic solution | | Conditions of electrolysis | | | | | |
|---|---|---|---|---|---|---|---|
| HCl (Mole/l) | β-dicarbonyl compound (g/l) | Bath temp. (°C.) | Current density (A/dm²) | Time (sec.) | Average roughness Ra (μ) | (a) Microscopic topography | (b) Macroscopic surface appearance |
| (18 g/l) | 5 | | | | | | |

(a) Microscopic topographies are those observed under magnification to 1,200 diameters using a scanning electron microscope.
O — good (uniform)
X — poor (non-uniform)
(b) Macroscopic surface appearances are the visually observed surface conditions of the grained sheet.
O — good (even)
X — poor (uneven)

EXAMPLE 8

The electrolytically etched grained sheets of Example 2 and Comparative Example 1 were subsequently desmutted in an aqueous 5% sodium hydroxide solution at 60° C. for 10 seconds, neutralized, and then washed with water. Thereafter they were anodized in 20% sulfuric acid at 20° C. and 3 A/dm² for 1 minute and coated with an o-quinonediazide-type sensitizing solution to prepare printing plates.

The plates were exposed through a positive transparency and developed. When the printing plate obtained with the sheet of Example 2 was used in offset printing, it exhibited a superior hydrophilicity and water retention and was easy of printing. It was still in a printable condition after 200,000 impressions had been printed therewith.

The printing plate obtained with the sheet of Comparative Example 1 was also used in printing under the same conditions. In this case, however, after printing of 100,000 impressions, a portion of the image area peeled off, which caused the ink to adhere badly, and it was impossible to continue the printing any further.

Having now fully described this invention, it will be apparent to one of ordinary skill in the art that many changes and modifications can be made thereto without departing from the spirit or scope of the invention as set forth herein.

What is claimed as new and intended to be covered by Letters Patent is:

1. A process for preparing lithographic printing plate bases, which comprises electrolytically etching a sheet made of aluminum or an aluminum alloy in an electrolytic solution containing sufficient amount of hydrochloric acid and a β-dicarbonyl compound to produce grains suitable for use as printing plates.

2. The process according to claim 1, wherein the electrolytic solution contains 3.5 to 35 g/l of hydrochloric acid and 0.01–20 g/l of a β-dicarbonyl compound.

3. The process according to claim 2, wherein the electrolytic solution contains 3.5 to 35 g/l of hydrochloric acid and 0.1–10 g/l of a β-dicarbonyl compound.

4. The process according to claim 1, wherein the β-dicarbonyl compound is acetylacetone, methyl acetoacetate, ethyl acetoacetate or ethyl malonate.

5. The process according to claim 4, wherein the β-dicarbonyl compound is acetylacetone.

6. The process according to claim 1, wherein the bath temperature is in the range of 10° to 40° C.

7. The process according to claim 1, wherein the sheet is electrolytically etched at a current density of 20 to 200 A/dm².

8. A process for preparing lithographic printing plate bases, which comprises electrolytically etching a sheet made of aluminum or an aluminum alloy in an electrolytic solution containing about 3.5 to 35 g/l of hydrochloric acid and about 0.01 to 20 g/l of a β-dicarbonyl compound at a bath temperature of 10° to 40° C., and anodizing the sheet in an aqueous electrolytic solution containing sulfuric acid or phosphoric acid.

9. The process according to claim 8, wherein the etched sheet is anodized at a current density of 1 to 10 A/dm².

10. The process according to claim 8, wherein the concentration of sulfuric acid or phosphoric acid is in the range of 10 to 50%.

* * * * *